US008864223B2

(12) United States Patent
Larson et al.

(10) Patent No.: US 8,864,223 B2
(45) Date of Patent: Oct. 21, 2014

(54) QUAD CHAIR HAVING A TRAY ASSEMBLY AND METHOD OF USING

(71) Applicant: American Recreation Products, LLC., Boulder, CO (US)

(72) Inventors: Nels Larson, Boulder, CO (US); Erin Doubleday, Boulder, CO (US); Matt Wagner, Boulder, CO (US)

(73) Assignee: American Recreation Products, LLC., Boulder, CO (US)

( * ) Notice: Subject to any disclaimer, the term of this patent is extended or adjusted under 35 U.S.C. 154(b) by 102 days.

(21) Appl. No.: 13/686,035

(22) Filed: Nov. 27, 2012

(65) Prior Publication Data

US 2013/0292971 A1 Nov. 7, 2013

Related U.S. Application Data

(60) Provisional application No. 61/643,601, filed on May 7, 2012.

(51) Int. Cl.

| | |
|---|---|
| ***A47C 4/00*** | (2006.01) |
| ***A47D 1/02*** | (2006.01) |
| ***A47C 7/70*** | (2006.01) |
| ***A47B 83/02*** | (2006.01) |
| ***A47C 4/28*** | (2006.01) |

(52) U.S. Cl.

CPC . *A47B 83/02* (2013.01); *A47C 7/70* (2013.01); *A47C 4/286* (2013.01)

USPC ..... 297/44; 297/16.2; 297/45; 297/173; 297/145

(58) Field of Classification Search

USPC ..... 297/42, 44, 45, 173, 16.1, 16.2, 18, 41, 297/56, 170, 188.14, 188.01, 188.18, 135, 297/145

See application file for complete search history.

(56) References Cited

U.S. PATENT DOCUMENTS

| | | | | |
|---|---|---|---|---|
| 1,898,834 | A * | 2/1933 | Hayes | 297/162 |
| 5,873,624 | A * | 2/1999 | Simpson | 297/45 |
| 6,247,750 | B1 * | 6/2001 | Tsai | 297/16.2 |
| 6,364,411 | B1 * | 4/2002 | Zheng | 297/173 |
| 6,644,731 | B2 * | 11/2003 | Tang | 297/16.2 |
| 6,899,383 | B2 * | 5/2005 | Hwang | 297/16.2 |
| 7,189,164 | B1 * | 3/2007 | Paesang et al. | 472/118 |
| 7,328,940 | B2 * | 2/2008 | Zheng | 297/44 |
| 7,967,374 | B2 * | 6/2011 | Akkad | 297/42 |
| 2012/0126587 | A1 * | 5/2012 | Seo | 297/173 |
| 2014/0110976 | A1 * | 4/2014 | Tang | 297/173 |

OTHER PUBLICATIONS

Coleman Aluminum Deck Chair with Swivel Table, http://www.coleman.com/product/aluminum-deck-chair-with-swivel-table/2000007752, 1 page; admitted prior art; retrieved on Apr. 18, 2013.

* cited by examiner

*Primary Examiner* — Chi Q Nguyen
(74) *Attorney, Agent, or Firm* — Armstrong Teasdale LLP.

(57) ABSTRACT

A collapsible quad chair has a frame selectively moveable between a collapsed configuration of the chair and a use configuration of the chair, and a fabric frame cover attachable to the frame to define a back portion and a seat portion of the chair. A support is coupled to the frame and a plate is mounted on the support. The plate is sized and shaped to provide a user sitting in the chair with a surface suitable for allowing the user to rest a dish of food while eating a meal while sitting in the chair.

14 Claims, 11 Drawing Sheets

QUAD CHAIR HAVING A TRAY ASSEMBLY AND METHOD OF USING

CROSS-REFERENCE TO RELATED APPLICATION

This application claims the benefit of U.S. Provisional Application No. 61/643,601 filed May 7, 2012, which is incorporated herein in its entirety

BACKGROUND

The field of the invention relates generally to quad chairs and more particularly to quad chairs having a tray assembly.

Known quad chairs, which are collapsible, are popular with consumers because they can be readily folded and stored. Such features enable quad chairs to be transported and used during recreational activities, such as during camping. Known collapsible quad chairs include a frame that is selectively moveable between a collapsed or folded configuration when the chair is not in use and a non-folded configuration during use. A fabric frame cover is coupled to the frame to define a back portion and a seat portion of the quad chair such that a user may sit on the seat portion and have his or her back positioned against the back portion. Such collapsible quad chairs may also include arms or armrests that have a cup holder. The cup holder enables the user to place, for example, a drinking cup within the cup holder.

However, known collapsible quad chairs do not include a portion for positioning, for example, a plate thereon. As such, while a user may be able to place a drink within the cup holder during a meal, the user would need to position a plate of food on the ground or, more commonly, on his or her lap. Therefore, known collapsible quad chairs do not provide a convenient or comfortable setting for the user to eat from a dish (e.g., a paper or plastic disposable plate) of food while sitting in the chair.

BRIEF DESCRIPTION

In one aspect, a collapsible quad chair generally comprises a frame selectively moveable between a collapsed configuration of the chair and a use configuration of the chair, and a fabric frame cover attachable to the frame to define a back portion and a seat portion of the chair. A support is coupled to the frame and a plate is mounted on the support. The plate is sized and shaped to provide a user sitting in the chair with a surface suitable for allowing the user to rest a dish of food while eating a meal while sitting in the chair.

In another aspect, a collapsible quad chair generally comprises a frame selectively moveable between a collapsed configuration of the chair and a use configuration of the chair. A tray assembly is coupled to the frame wherein the tray assembly includes a support and a plate mounted on the support.

In yet another aspect, a method of using a collapsible quad chair generally comprises moving a frame between a collapsed configuration of the chair and a use configuration of the chair. A fabric frame cover is attached to the frame and defines a back portion and a seat portion of the chair. A support coupled to the frame is extendable during the use configuration of the chair. A plate mounted on the support is moveable to enable a user sitting in the chair to be provided with a surface suitable for allowing the user to rest a dish of food while eating a meal while sitting in the chair.

DETAILED DESCRIPTION OF THE DRAWINGS

The exemplary collapsible quad chair and methods described herein overcome at least some known disadvantages associated with at least some known collapsible quad chairs. More specifically, the embodiments described herein provide a collapsible quad chair that includes a tray assembly that enables a user sitting in the chair to be provided with a surface suitable for allowing a user to rest a dish (e.g., a paper or plastic disposable plate) of food while eating a meal while sitting in the chair. Accordingly, the collapsible quad chair provides a convenient or comfortable setting for the user to be able to eat a dish of food while sitting in the chair.

Figure 1:
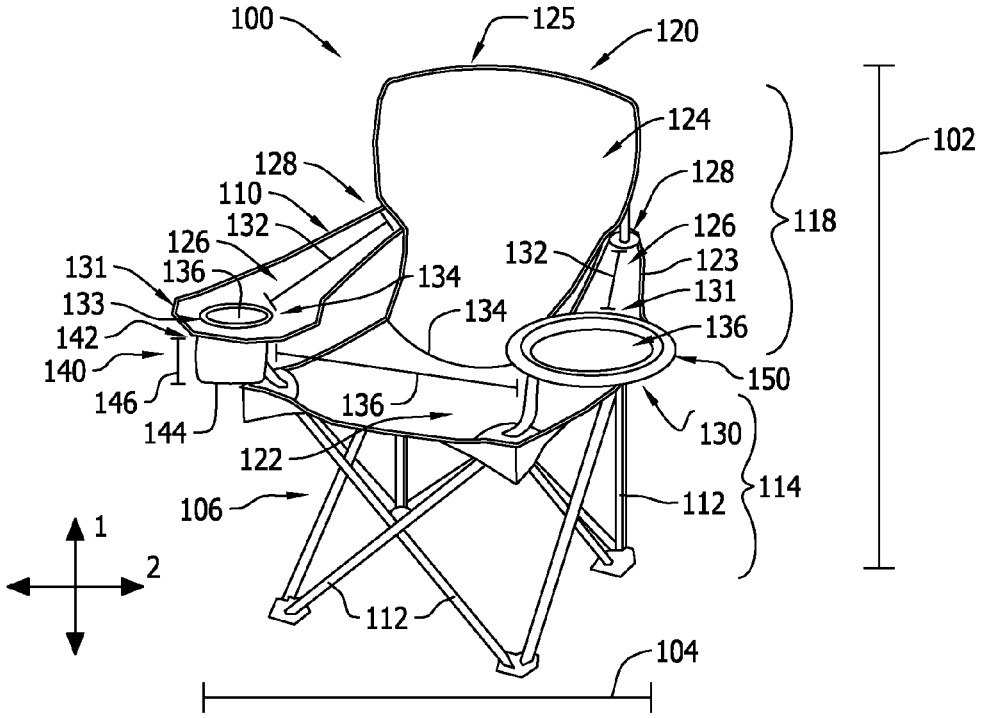
FIG. 1 is a perspective view of an exemplary collapsible quad chair in a use configuration of the quad chair.
Figure 1A:
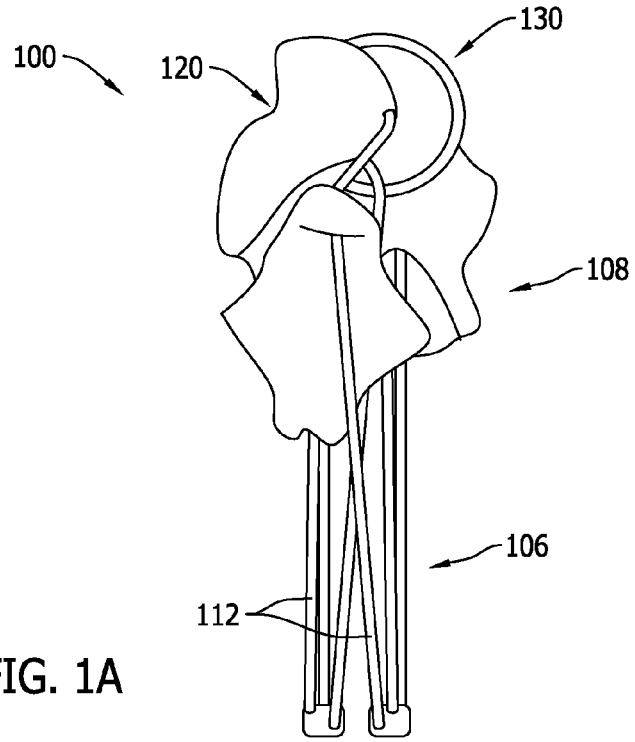
FIG. 1A is a perspective view of a collapsed configuration of the quad chair shown in FIG. 1.

FIG. 1 illustrates an exemplary collapsible quad chair 100 that extends a length 102 in a longitudinal direction 1 and a width 104 that extends in a lateral direction 2. More specifically, in the illustrated embodiment, the chair 100 includes a frame 106 that defines a framework for the chair 100. The frame 106 is selectively moveable between a collapsed configuration 108, as shown in FIG. 1A, and a use configuration 110, as shown in FIG. 1. For example, the frame 106 may be folded to form the collapsed configuration 108 such that the width 104 of the frame 106 is substantially decreased and the chair 100 may be stored in, for example, a trunk of a car or a closet. Alternatively, the frame 106 may be extended from the collapsed configuration 108 to form the use configuration 110 wherein the width 104 of the frame 106 is substantially increased and a user may sit on the chair 100. The frame 106 may be fabricated from plastic, metal (e.g., steel, aluminum) or any suitable material that enables the chair 100 to function as described herein.

In the illustrated embodiment, the frame 106 includes a plurality of segments 112 that define a base portion 114 and a top portion 118. A fabric frame cover 120 is coupled to the frame 106 to define a seat portion 122, a back portion 124, and two arms 126 of the chair 100. More specifically, in the illustrated embodiment, a portion of the fabric frame cover 120 is coupled to the frame base portion 114 to define the seat portion 122 and a portion of the fabric frame cover 120 is coupled to the frame top portion 118 to define the back portion 124. Accordingly, during use, the user may be seated on the seat portion 122 and the user may position his or her back against the back portion 124. In the illustrated embodiment, the seat portion 122 and back portion 124 of the fabric frame cover 120 are formed as a single-piece. It is understood, however, that the seat portion 122 and back portion 124 can be formed as separate pieces.

Figure 4:
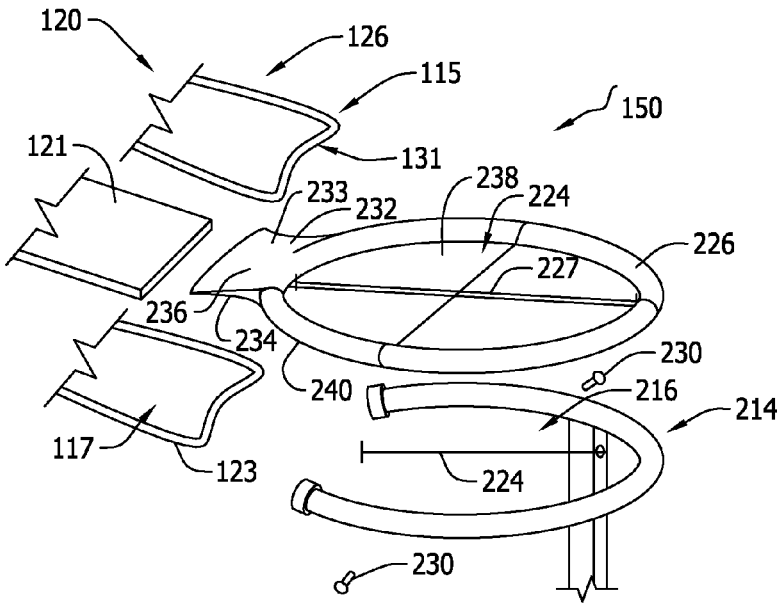
FIG. 4 is an enlarged exploded view of a portion of the tray assembly shown in FIGS. 3A to 3F.

In the illustrated embodiment, the fabric frame cover 120 includes at least one layer of suitable fabric. For example, the fabric frame cover 120 can be manufactured from a wide selection of materials, such as, but not limited to, synthetic fibers (for example, polyester or polypropylene fibers), natural fibers (for example, wood or cotton fibers), and/or a combination of natural and synthetic fibers. As shown in FIG. 4, in one embodiment, the fabric frame cover 120 includes a first layer of fabric 115, a second layer of fabric 117, and a padded material 121 sandwiched between and captured by the first and second layers of fabric 115, 117. The padded material 121 may include foam for providing cushioning to the user. Examples of suitable foam include a closed-cell polyolefin foam, a foam with a negative Poissons ratio and other similar foams. The fabric frame cover 120 may also include a binding portion 123 (or trim) that defines an outer periphery 125 of the fabric frame cover 120. The binding portion 123 of the fabric frame cover 120 may also be a textile material that can be manufactured from a wide selection of materials, such as, but not limited to, synthetic fibers (for example, polyester or polypropylene fibers), natural fibers (for example, wood or cotton fibers), and/or a combination of natural and synthetic fibers.

Figure 2:
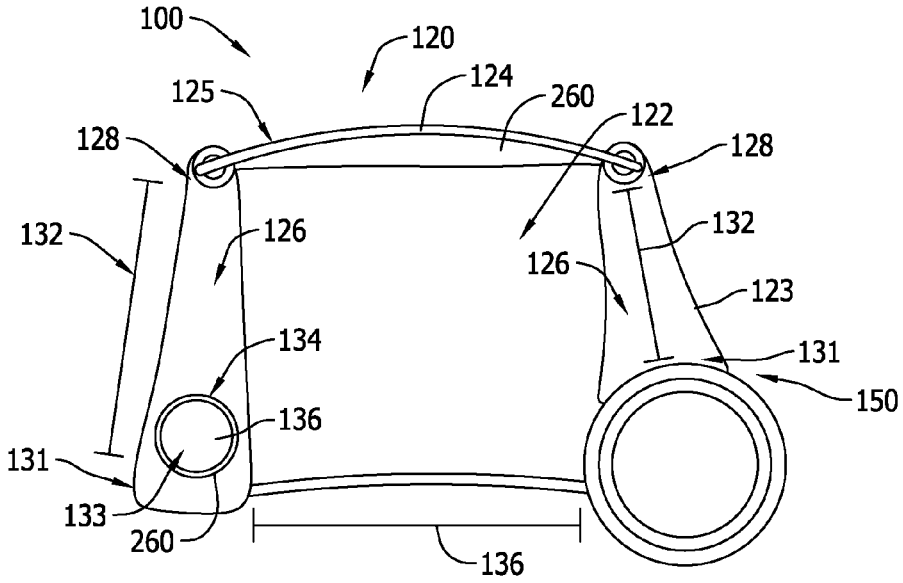
FIG. 2 is a top plan view of the collapsible quad chair shown in FIG. 1.

Referring to FIGS. 1 and 2, the illustrated quad chair 100 includes a pair of arms 126. One of the arms 126 extends outward from the right side of the back portion 124 (as viewed in FIG. 1), and the other arm extends outward from the left side of the back portion (as viewed in FIG. 1). More specifically, each arm 126 includes a first end 128 positioned adjacent to the respective side of the back portion 124 and a second end 131 spaced a predefined distance 132 from the first end 128. Moreover, the arms 126 are spaced apart by a predefined distance 136, such as, for example, approximately a width of the seat portion 122. Accordingly, when the user is seated on the seat portion 122, the user may have each arm positioned on one of the arms 126. While the illustrated embodiment includes the arm 126 being fabricated and defined by the fabric frame cover 120, one of ordinary skill in the art will appreciate that the arms 126 can also be fabricated separate from the fabric frame cover and/or made from other suitable materials.

With reference still to FIGS. 1 and 2, a tray assembly 130 and a cup holder 133 are removably coupled to or integrally formed to the frame 106 and the fabric frame cover 120, respectively. For example, in the illustrated embodiment, the tray assembly 130 extends from the frame base portion 114 and is coupled to the second end 131 of one of the arms 126. The cup holder 133, on the other hand, is defined within the fabric frame cover 120 of the second end 131 of the other arm 126. It is contemplated that cup holder 133 can be omitted. It is also contemplated that tray assembly 130 can be positioned on either side of the chair 100. In the illustrated embodiment, for example, the tray assembly 130 is positioned on the right side of the chair 100 (as viewed in FIG. 1) but it is contemplated that the tray assembly can be positioned on the left side of the chair. It is further contemplated that tray assemblies 130 can be positioned on both arms 126. That is, the chair 100 can have two tray assemblies 130.

As seen in FIGS. 1 and 2, the cup holder 133 includes an end portion 134 that defines a substantially circular opening 136. Moreover, the cup holder 133 includes a portion of the fabric frame cover 120 that extends through the circular opening 136 to define a substantially cylindrical pocket 140 having an opened first end portion 142 coupled to the opening 136 and a closed second end portion 144 that extends a predefined distance 146 from the first end portion 142. Accordingly, a cylindrical object (e.g., a cup, a can, a bottle) may be positioned within the pocket 140. The second end portion 144 can be fabricated from substantially the same material as the fabric frame cover 120. It is contemplated, however, that the second end portion 144 can be fabricated from any suitable material, such as a mesh or web material.

Figure 5A:
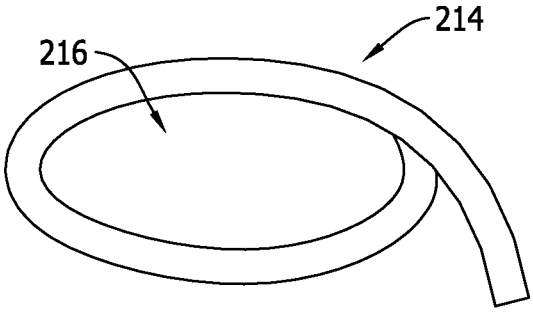
FIG. 5A is a perspective view of a portion of another support that may be used with the tray assembly shown in FIGS. 3A to 4.
Figure 5B:
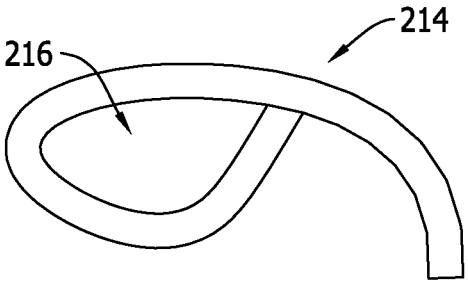
FIG. 5B is a perspective view of a portion of yet another support that may be used with the tray assembly shown in FIGS. 3A to 4.
Figure 6:
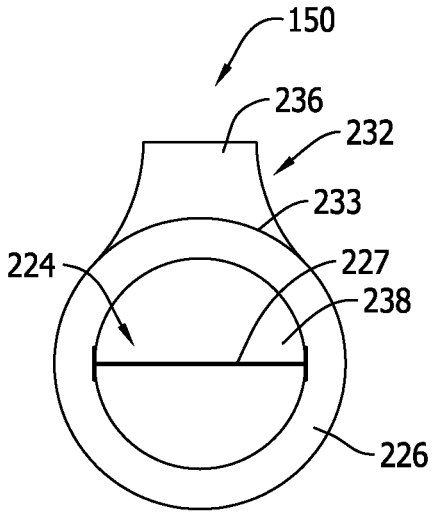
FIG. 6 is top plan view of an exemplary plate that may be used with the tray assembly shown in FIGS. 3A to 4.
Figure 7:
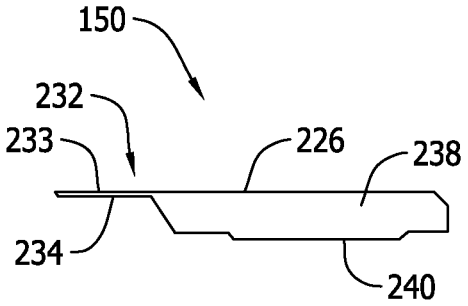
FIG. 7 is a left side view of the plate shown in FIG. 6.
Figure 8:
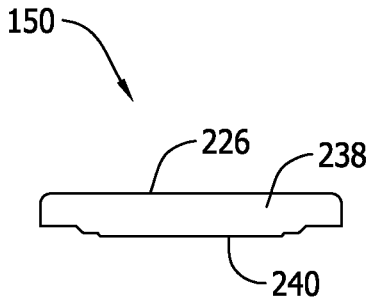
FIG. 8 is a front view of the plate shown in FIG. 6.
Figure 9:
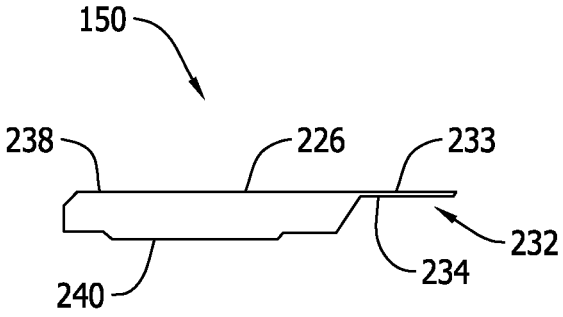
FIG. 9 is a right side view of the plate shown in FIG. 6.

The tray assembly 130 includes a plate 150 that is sized and shaped for allowing the user to rest a dish (e.g., a paper or plastic disposable plate) of food while eating a meal while sitting in the chair 100 (FIGS. 1 and 2). As illustrated in FIGS. 3A to 3F, the tray assembly 130 includes a support 202 comprising a lower, outer tube 204 that, in the illustrated embodiment, is integrally formed with the frame 106 and an upper, inner tube 206 that is telescopically received in the outer tube 204. More specifically, in the exemplary embodiment, the inner tube 206 has a first end portion 210 positioned substantially within the outer tube 204, a middle portion 212, and a second end portion 214 extending outwardly from the outer tube 204. As illustrated FIG. 4, the second end portion 214 of the inner tube 206 is generally ring shaped and defines an opening 216. In the embodiment illustrated in FIG. 4, the second end portion 214 of the inner tube 206 is a discontinuous ring (i.e., a segment of the ring is removed). It is contemplated, however, that the ring can be continuous as illustrated in FIG. 5A. It is also contemplated that the second end portion 214 of the inner tube 206 can have other suitable shapes (e.g., the second end portion 214 of the inner tube 206 illustrated in FIG. 5B is generally ovate).

As seen in FIGS. 3A-3F, the plate 150 is mounted on the second end portion 214 of the inner tube 206. The plate 150 can be integrally formed with the second end portion 214 of the inner tube 206, can be formed separately from the second end portion 214 and permanently attached thereto, or can be formed separately from the second end portion and releasably attached thereto. As illustrated in FIGS. 6 to 11, the plate 150 includes a circular disk 224 and an annular ridge 226 extending circumferentially about the disk 224. The dimensions, such as the diameter 227, of the disk 224 can be predetermined to enable at least one object, such as a food dish (not shown), to be positioned on the disk. While the illustrated plate 150 includes a circular disk 224, it will be appreciated that the plate 150 can have any suitable shape.

Figure 10:
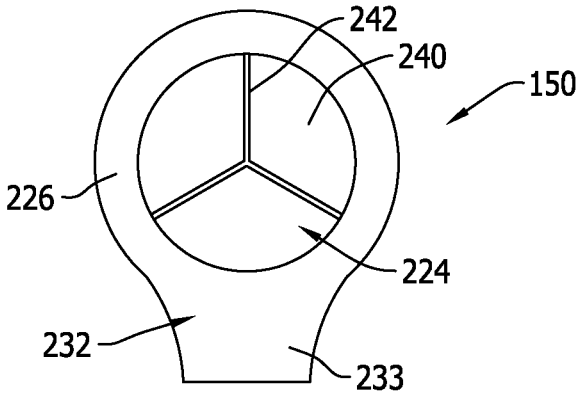
FIG. 10 is a bottom view of the plate shown in FIG. 6.
Figure 11:
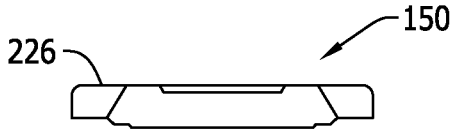
FIG. 11 is a rear view of the plate shown in FIG. 6.

The disk 224 also includes an upper surface 238 (FIG. 6) and an opposing bottom surface 240 (FIG. 10). The upper surface 238 is configured such that at least one object, such as an eating dish, may be positioned thereon. The disk's upper surface 238 may include a design molded therein, such as a graphic pattern, a textual pattern and/or numeric value(s). It is also contemplated that the upper surface 238 of the disk 224 can be formed by or coated with a material (e.g., an elastomeric material, a rubber material) to increase friction between the plate 150 and objects placed thereon. The disk's bottom surface 240 may include embossed grooves 242 or ribs to increase stability against deformation, such as bending.

In the illustrated embodiment, the annular ridge 226 of the plate 150 is coupled to the second end portion 214 of the inner tube 206 such that the circular disk 224 is positioned within the opening 216 of the second end portion. Thus, the diameter 227 of the circular disk 224 is less than the diameter 229 of the opening 216 so that the disk 224 fits within the opening 216. Referring to FIG. 4, at least one fastener 230, such as a bolt, may be used to couple the plate 150 to the support 202 and, more specifically, to the second end portion 214 of the inner tube 206. It is understood that the plate 150 can be coupled to the support 202 in other suitable ways (e.g., adhesive, snap-fit, hook and loop).

Referring now to FIG. 4, the illustrated plate 150 includes a tab 232 that extends outwardly from the plate 150. The tab 232 is configured for attaching the plate 150 to the second end 131 of one of the arms 126. In the illustrated embodiment, the tab 232 includes an upper surface 233 and an opposing bottom surface 234, wherein at least one channel 236 is defined within the tab upper surface 233. As seen in FIG. 4, the first layer of fabric 115 of the arm 126 is bonded to the upper surface 233 of the tab 232 and the second layer of fabric 117 is bonded to the bottom surface 234 of the tab. As a result, the plate 150, and more specifically the tab 232 of the plate, is captured by the first and second layers of fabric 115, 117 defining the arm 126.

As seen in FIGS. 3A to 3D, the inner tube 206 of the support 202 is telescopically received within the outer tube 204 of the support. Thus, the inner tube 206 can be moved upward and downward in the longitudinal direction 1 within the outer tube 204 such that the longitudinal extent or height of the support 202 is selectively adjustable. A fastener 260 (e.g., a ball or pin) extending transversely outward from the inner tube 206 can be used to securely couple the inner tube 206 to the outer tube 204 such that the inner tube 206 is not movable relative to the outer tube 204. In one suitable embodiment, the telescopic connection between the inner and outer tubes 206, 204 of the supports 202 allows the height of the tray assembly 130, and more specifically the plate 150, to be adjustable. In such an embodiment, the user of the quad chair 100 can selectively adjust the height of the plate 150.

Figure 3A:
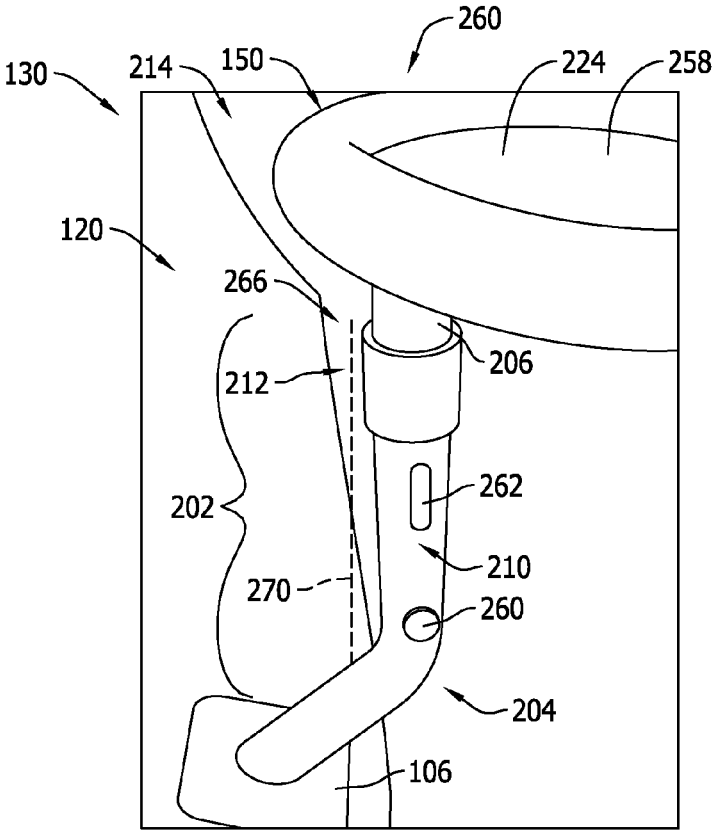
FIGS. 3A to 3F are enlarged perspective views of a portion of an exemplary tray assembly of the collapsible quad chair shown in FIG. 1.
Figure 3B:
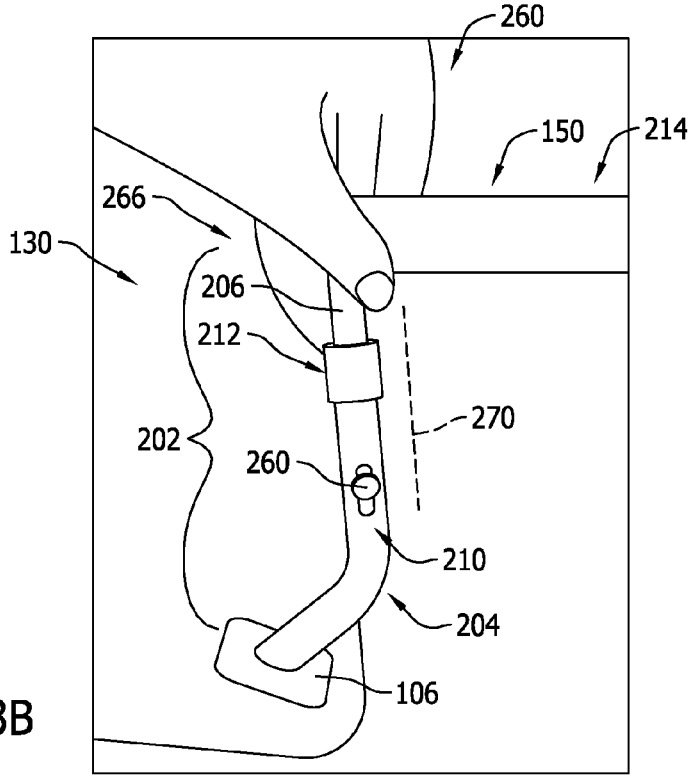
Figure 3C:
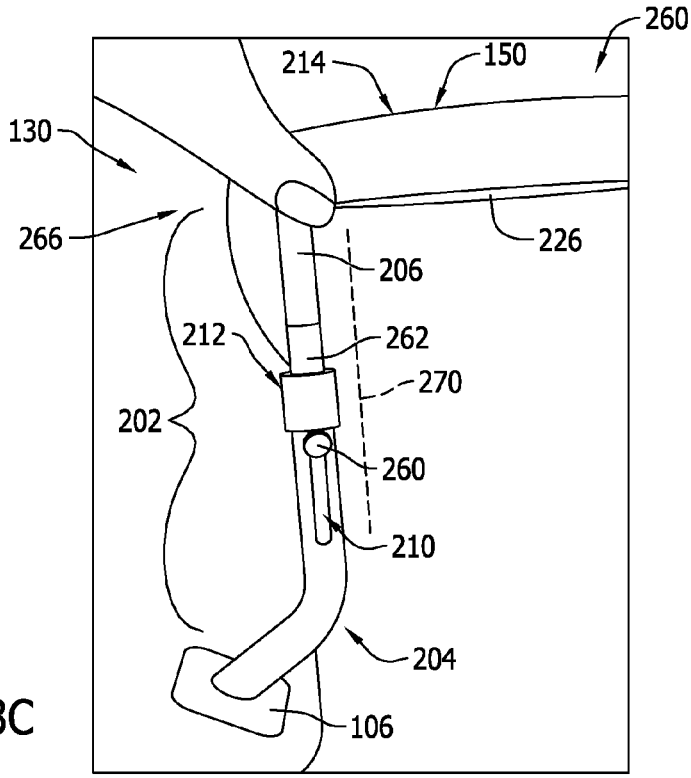
Figure 3D:
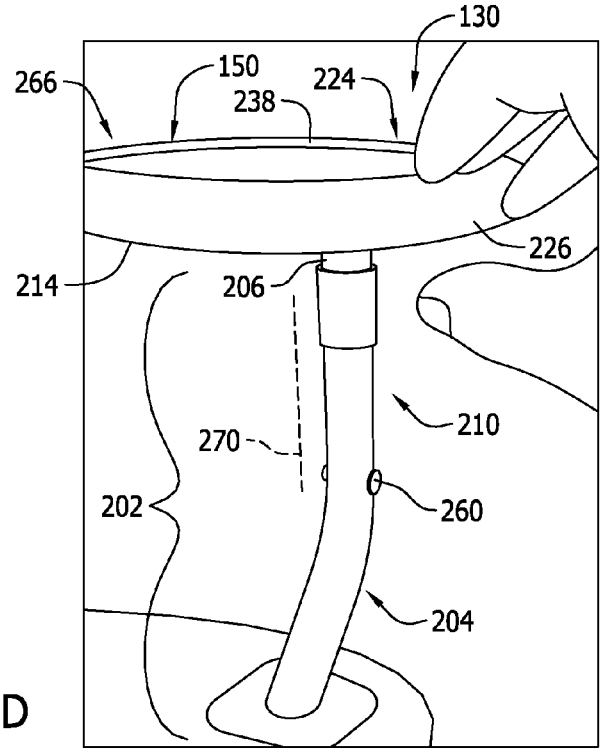
Figure 3E:
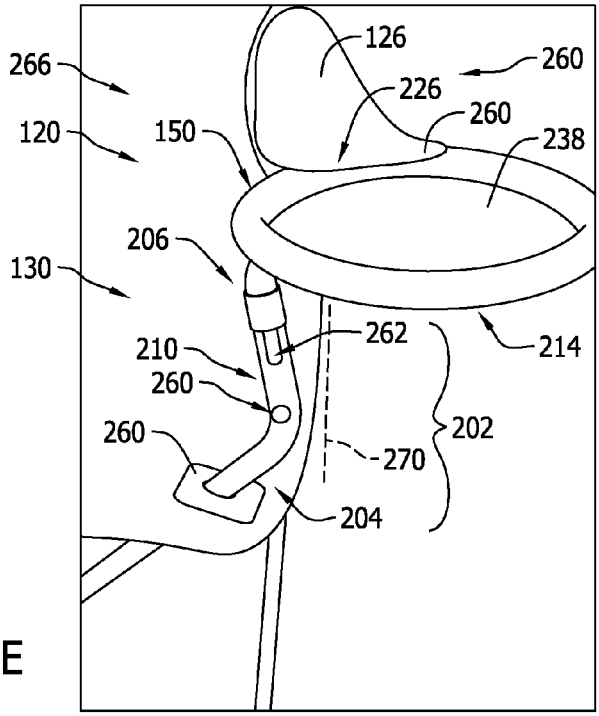
Figure 3F:
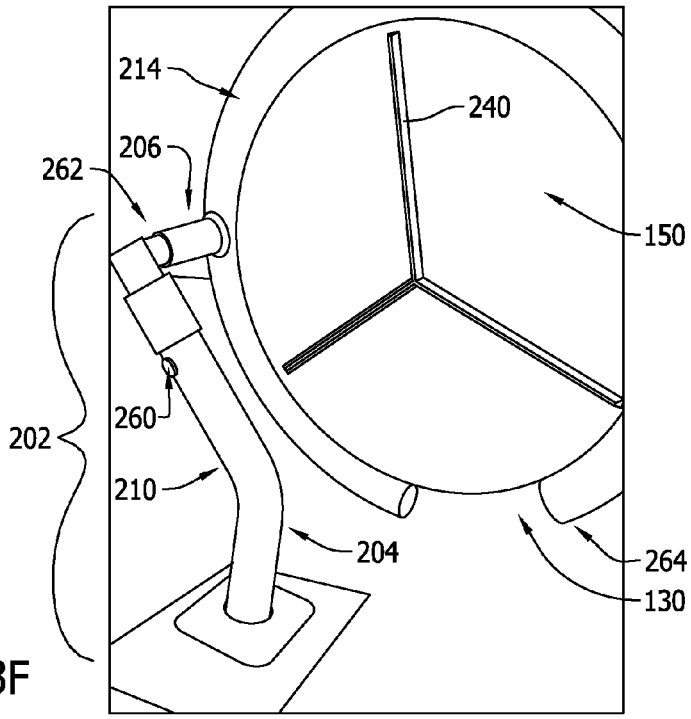

Moreover, as illustrated in FIGS. 3A to 3F, the middle portion 212 of the inner tube 206 includes a hinge 262 for pivoting the plate 150 between a stowed position 264, as shown in FIG. 3F, and an operable position 266, as shown in FIGS. 3A to 3E. More specifically, in the illustrated embodiment, the hinge 262 facilitates the second end portion 214 of the inner tube 206 to pivot such that the first end portion 210 and the middle portion 212 are substantially vertical with respect to the seat portion 122, and the second end portion 214, along with the plate 150, are each substantially horizontal with respect to the seat portion 122 when the plate 150 is in an operable position 266. As also seen in FIG. 3A, the telescopic connection between the inner and outer tubes 204, 204 allow the hinge 262 to be at least partially received within the outer tube in the operable position 266 of the plate 150. In the illustrated embodiment, the hinge 262 is fully received within the outer tube in the operable position 266 of the plate 150. It is understood that other suitable hinge configurations can be used.

As seen in FIG. 3D, the first end portion 210 and the middle portion 214 define a generally vertical axis 270, and the second end portion 214 defines a generally horizontal axis. The one suitable embodiment, the second end portion 214 is rotatable about the vertical axis 270. In such an embodiment, the user of the chair 100 can selectively rotate the plate 150 toward themselves when seated in the chair (e.g., while eating) and away from themselves (e.g., when getting into and out of the chair). As seen in FIG. 3F, the hinge 262 facilitates the second end portion 214 of the inner tube 206 to pivot such that the second end portion 214, along with the plate 150, are each substantially vertical with respect to the seat portion 122 when the plate 150 is in a stowed position 264.

Figure 12A:
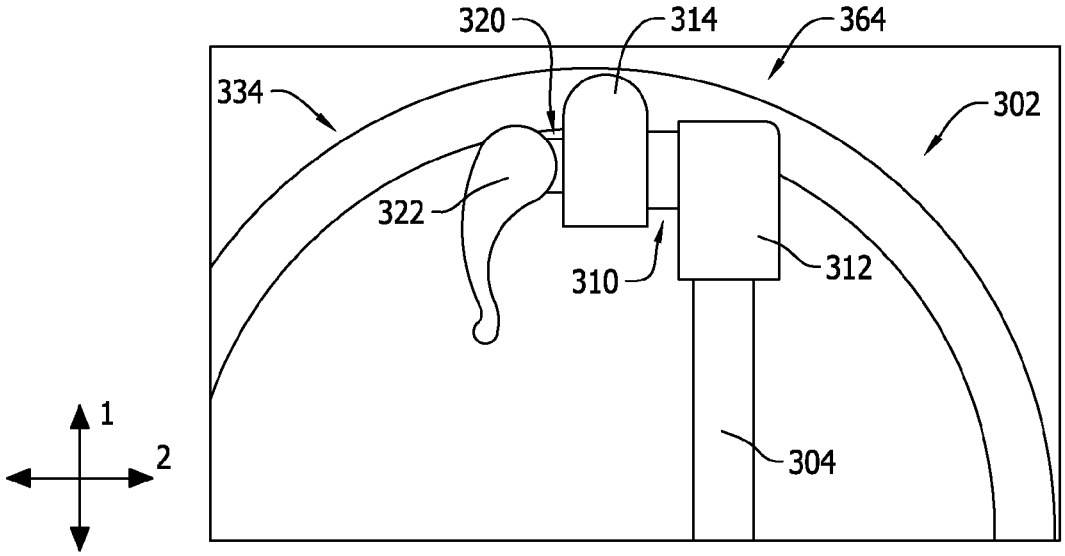
FIGS. 12A and 12B are enlarged plan views of a portion of an alternative tray assembly that may be used with the collapsible quad chair shown in FIG. 1.
Figure 12B:
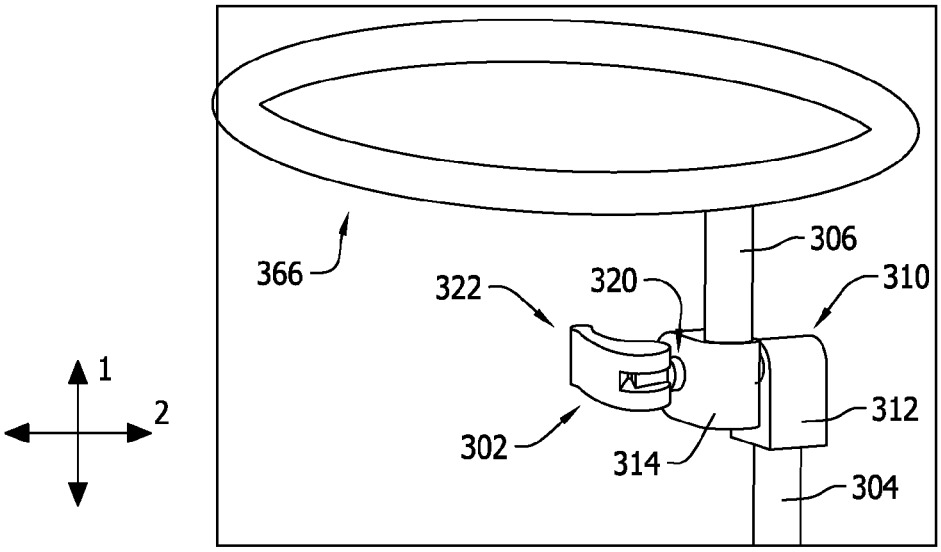
Figure 12C:
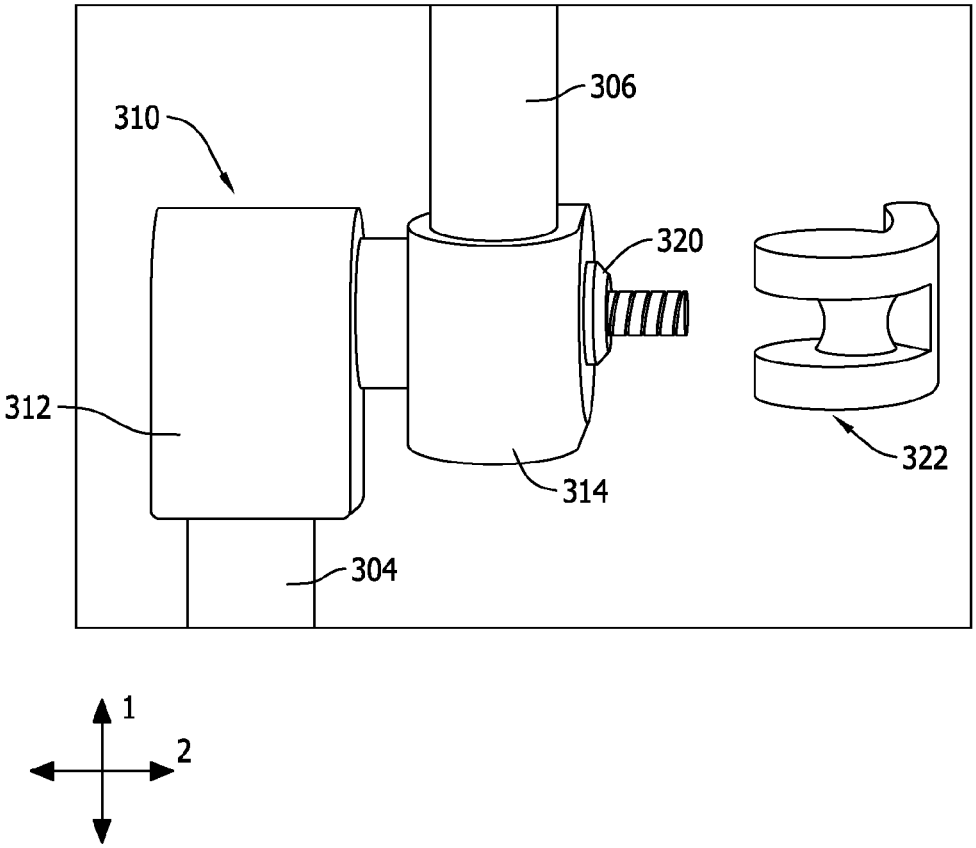
FIG. 12C is a partially exploded view of a portion of the tray assembly shown in FIGS. 12A and 12B.

FIGS. 12A to 12C illustrate a portion of another embodiment of a support 302 suitable for use with the collapsible quad chair 100. In this embodiment, the support 302 has a lower tube 304 and an upper tube 306 coupled to the lower tube via a coupling portion 310. In the illustrated embodiment, the coupling portion 310 has a first coupling member 312 attached to an upper end of the lower tube 304, and a second coupling member 314 attached to a lower end of the upper tube 306. The first and second coupling members 312, 314 are configured such that the upper tube 306 can be pivoted with respect to the lower tube. Thus, the plate 150 (when attached to the support 302) can be moved between a stowed position 364 (FIG. 12A) and an operable position 366 (FIG. 12B). In this embodiment, the first and second coupling members 312, 314 also allow the upper tube 306 to be separated from the lower tube 304. Thus, the upper tube 306 of the support 302 can be completely removed from the chair 100.

As seen in FIG. 12C, the first coupling member 312 includes a stem 320 having a threaded segment sized and shaped to extend through an opening in the second coupling member 314. A clamp member 322 is adapted to threadingly engage the threaded segment of the stem 320 and thereby secure the upper and lower tubes 306, 304 together. The clamp member 322 is selectively engageable and disengageable with the stem 320. When engaged, the clamp member 322 is moveable between a secured positioned wherein the upper and lower tubes 306, 304 are securely held together and a loosened positioned wherein the upper tube 306 can be pivoted with respect to the lower tube 304. When disengaged, the upper tube 306 (and thus the plate 150 when attached to the upper tube) can be separated from the lower tube 304. It is understood that the plate 150 and more broadly the tray assembly 130 can be selectively attachable and detachable from the quad chair 100 in other suitable ways.

As compared to known collapsible quad chairs, the embodiments described herein provide a collapsible quad chair having a tray assembly that enables a user sitting in the chair to be provided with a surface suitable for allowing the user to rest a dish of food while eating a meal while sitting in the chair.

Exemplary embodiments of the collapsible quad chair and methods are described above in detail. The collapsible quad chair and methods are not limited to the specific embodiments described herein, but rather, components of the collapsible quad chair and/or steps of the methods may be utilized independently and separately from other components and/or steps described herein. For example, the systems may also be used in combination with other systems and methods, and is not limited to practice with only the embodiments as described herein. Rather, the exemplary embodiment can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A collapsible quad chair comprising:

a frame selectively moveable between a collapsed configuration of the chair and a use configuration of the chair;

a fabric frame cover attachable to the frame to define a back portion and a seat portion of the chair;

a support coupled to the frame, wherein the support comprises an outer tube, an inner tube telescopically received in the outer tube, and a hinge; and a plate mounted on the support, the plate being mounted on the inner tube of the support, the plate pivoting between a stowed position and an operable position using the hinge, the plate being sized and shaped to provide a user sitting in the chair with a surface suitable for allowing the user to rest a dish of food while eating a meal while sitting in the chair.

2. The collapsible quad chair set forth in claim 1 further comprising a pair of chair arms having a first end positioned adjacent the back portion of the fabric frame cover, and a second end spaced from the back portion of the fabric frame cover, the plate being disposed adjacent the second end of one of the chair arms when in the operable position.

3. The collapsible quad chair set forth in claim 1 wherein the hinge is located on the inner tube.

4. The collapsible quad chair set forth in claim 1 wherein the plate comprises a generally circular disk and an annular ridge extending about the circular disk.

5. A collapsible quad chair comprising:

a frame selectively moveable between a collapsed configuration of the chair and a use configuration of the chair;

a fabric frame cover attachable to the frame to define a back portion and a seat portion of the chair;

a support coupled to the frame; and a plate mounted on the support, wherein the plate comprises a generally circular disk, an annular ridge extending about the circular disk, and a tab extending outward from the annular ridge, the plate being sized and shaped to provide a user sitting in the chair with a surface suitable for allowing the user to rest a dish of food while eating a meal while sitting in the chair.

6. The collapsible quad chair set forth in claim 5 further comprising a pair of chair arms, the tab of the plate being secured to one of the arms.

7. The collapsible quad chair set forth in claim 6 wherein the other one of the arms comprises a cup holder.

8. A collapsible quad chair comprising:

a frame selectively moveable between a collapsed configuration of the chair and a use configuration of the chair;

a fabric frame cover attachable to the frame to define a back portion and a seat portion of the chair;

a support coupled to the frame, wherein the support comprises a generally vertical tube, a ring extending generally horizontal from the tube, and a hinge; and a plate mounted on the support, the plate pivoting between a stowed position and an operable position using the hinge, the plate being sized and shaped to provide a user sitting in the chair with a surface suitable for allowing the user to rest a dish of food while eating a meal while sitting in the chair.

9. The collapsible quad chair set forth in claim 8 wherein the tube defines a vertical axis in the operable position of the plate and the ring is rotatable about the vertical axis.

10. A collapsible quad chair comprising:

a frame selectively moveable between a collapsed configuration of the chair and a use configuration of the chair; and a tray assembly coupled to the frame, wherein the tray assembly comprises:

a support; and a plate mounted on the support, wherein the plate comprises a generally circular disk, an annular ridge extending about the circular disk, and a tab extending outward from the annular ridge.

11. The collapsible quad chair set forth in claim 10, further comprising a pair of chair arms, the tab of the plate being secured to one of the arms.

12. A method of using a collapsible quad chair, the method comprising:

moving a frame between a collapsed configuration of the chair and a use configuration of the chair, wherein a fabric frame cover is attached to the frame and defines a back portion and a seat portion of the chair;

extending a support coupled to the frame during the use configuration of the chair, wherein extending the support comprises extending an inner tube that is telescopically received in an outer tube, and wherein extending the support further comprises extending a support having a hinge; and moving a plate mounted on the support to enable a user sitting in the chair to be provided with a surface suitable for allowing the user to rest a dish of food while eating a meal while sitting in the chair, the plate being mounted on the inner tube of the support.

13. The method set forth in claim 12 further comprising pivoting the plate about the hinge between a stowed position and an operable position.

14. The method set forth in claim 12 wherein extending the inner tube comprises extending a hinge located on the inner tube from a position within the outer tube to a position outside the outer tube.

* * * * *